United States Patent [19]

Uchida et al.

[11] Patent Number: 4,917,983

[45] Date of Patent: Apr. 17, 1990

[54] TONER FOR DEVELOPING AN ELECTROSTATIC LATENT IMAGE COMPRISING LINEAR POLYESTER POLYMER

[75] Inventors: Masafumi Uchida; Hiroyuki Takagiwa; Satoru Ikeuchi, all of Hachioji, Japan

[73] Assignee: Konishiroku Photo Industry Co., Ltd., Tokyo, Japan

[21] Appl. No.: 183,332

[22] Filed: Apr. 7, 1988

Related U.S. Application Data

[63] Continuation of Ser. No. 910,651, Sep. 23, 1986, abandoned.

[30] Foreign Application Priority Data

Oct. 1, 1985 [JP] Japan ..... 60-216244
Oct. 2, 1985 [JP] Japan ..... 60-217995

[51] Int. Cl.[4] ..... G03G 9/08
[52] U.S. Cl. ..... 430/109; 430/904

[58] Field of Search ..... 430/109, 904

[56] References Cited

U.S. PATENT DOCUMENTS

| | | | |
|---|---|---|---|
| 3,124,456 | 3/1964 | Moore | 430/69 X |
| 3,681,106 | 8/1972 | Burns | 430/120 |
| 3,718,594 | 2/1973 | Miller | 430/137 |
| 4,049,447 | 9/1977 | Azay et al. | 430/107 X |
| 4,478,923 | 10/1984 | De Roo | 430/109 |
| 4,804,622 | 2/1989 | Tanaka et al. | 430/109 |

*Primary Examiner*—J. David Welsh
*Attorney, Agent, or Firm*—Jordan B. Bierman

[57] ABSTRACT

To overcome the problem of offset images in electrophotography when using a heated roller in fixing a toner image, a toner composition containing a non-linear polyester resin is used. The polyester resin is made from 1-60 mol % polyhydric alcohol having at least three hydroxy groups and 2-65 mol % of a polycarboxylic acid having at least three carboxy groups.

17 Claims, No Drawings

TONER FOR DEVELOPING AN ELECTROSTATIC LATENT IMAGE COMPRISING LINEAR POLYESTER POLYMER

This application is a continuation of application Ser. No. 910,651, filed Sept. 23, 1986, now abandoned.

FIELD OF THE INVENTION

The invention relates to a toner used for developing an electrostatic latent image formed in electrophotography, electrostatic printing, electrostatic recording and the like.

BACKGROUND OF THE INVENTION

In electrophotography, for example, an electrostatic latent image is principally formed on a latent image carrying member made of a photoconductive photoreceptor by means of an electrostatic charge or light exposure; then, the generated image is developed with a toner. The toner image obtained is, after being transferred on a support such as an image transfer sheet, fixed on the material with a means that includes heat or pressure to produce a visible image.

The production of such a visible image by way of the electrostatic image should preferably be executed at a high speed. In view of this, the heat roller fixing method, which features better efficiency and is more beneficial than other methods, has widely been practiced.

However, demand for more speed is mounting recently, and high speed fixation of the toner image is one of the essential prerequisites for satisfying this requirement.

The heat roller fixing method requires an image developing toner with an excellent low temperature fixing property so that the toner image may be rapidly fixed. For this purpose, a resin contained in the toner as a binder should have a lower softening point. However, if a toner binder has a lower softening point, a so-called offset phenomenon tends to occur. In this phenomenon, the toner, in order to form an image at fixation sequence partly transfers to the heat roller; then, the transferred toner is again transferred to the image transfer sheet that follows, contaminating the image.

For this reason, a toner which comprises, as a binder, a non-linear polyester obtained from the polymerization of monomer composition comprising an etherified bisphenol monomer, dicarboxylic acid monomer, a polyhydric alcohol containing at least 3 hydroxy groups and/or a polycarboxylic acid monomer containing at least 3 carboxylic acid groups was proposed. (See Japanese Patent Publication Open to Public Inspection No. 37353/1982 and No. 208559/1982; hereinafter referred to as Japanese Patent O.P.I. Publication.)

With the prior art above, the toner was provided with an offset prevention feature by incorporating, as a binder, a polyester obtained by inter-linking a linear polyester comprising an etherified bisphenol and a dicarboxylic acid monomer with monomer components including a polyhydric alcohol monomer containing at least 3 hydroxy groups and/or a polycarboxylic acid monomer containing at least 3 carboxylic acid groups.

This type of toner, however, has a relatively high softening point; therefore, it cannot satisfactorily perform fixation at low temperatures, and, it is difficult to achieve sufficiently rapid fixation with this type of toner.

In order to eliminate such a drawback, a certain toner having the following characteristics has been proposed. (See Japanese Patent O.P.I. publication No. 57-109825/1982, Japanese Patent Application No. 109539/1984, Japanese Patent O.P.I. Publication No. 7960/1984.) A polymer contained as a binder in the toner, having a saturated or unsaturated aliphatic hydrocarbon group with 3–22 carbon atoms in a side chain, is a non-linear copolymer obtained from the polymerization of monomer composition comprising an etherified bisphenol monomer, a dicarboxylic acid monomer, a polyhydric alcohol monomer containing at least 3 hydroxy groups and/or polycarboxylic acid monomer containing at least 3 carboxylic acid groups.

With such a toner, a sufficient fixing property is possible at low or medium speed fixation, however, if high speed fixation is continuously exercised at a fixing rate in excess of 50 A-3 size sheets/min. for example, because the papers are fed to the heat roller at extremely short intervals, the papers absorb a great amount of heat from the heat roller, causing the temperature of the roller to drop drastically, often resulting in improper fixation.

In view of such a drawback, a measure may be incorporated to improve the property of low temperature fixing by decreasing the molar weight of a binder which decreases toner viscosity during the fixation. However, such a measure simultaneously accompanies the deterioration of anti-offset properties of the toner; in addition, as the toner tends to aggregate, the movement of the toner as unit particles is hindered, making satisfactory image development impossible.

SUMMARY OF THE INVENTION

The present invention has been made in view of the drawbacks described above. The purpose is to provide a toner for developing an electrostatic latent image which, having an excellent anti-offset property, satisfactorily realizes high speed fixation because of its excellent low temperature fixing property, infrequent aggregation and stable movement as unit particles, making possible satisfactory image development.

DETAILED DESCRIPTION OF THE INVENTION

The toner according to the present invention for developing an electrostatic latent image features, as a binder, either a non-linear polyester which, having a long chained aliphatic hydrocarbon unit in the principal chain, is obtainable from polymerization of monomer composition comprising a polyhydric alcohol monomer containing at least 3 hydroxy groups and/or polycarboxylic acid monomer containing at least 3 carboxylic acid groups, or non-linear polyester which has a side chain containing a saturated or unsaturated aliphatic hydrocarbon group and has a principal chain containing a monomer unit containing a long chain apliphatic hydrocarbon unit.

More particularly, the present invention relates to a toner composition for developing an electrostatic latent image which comprises as a binder a non-linear polyester obtainable from polymerization of monomer composition comprising a polyhydric alcohol monomer containing at least 3 hydroxy groups and/or polycarboxylic acid monomer containing at least 3 carboxylic acid groups, wherein the non-linear polyester consists essentially of monomer units constituting the principal chains thereof and 1 to 60 mol% of the monomer units contain an aliphatic hydrocarbon unit having at least 3 carbon atoms, or the non-linear polyester consists essentially of monomer units constituting the principal chains thereof and other monomer units having a side chain, 2 to 65 mol% of the monomer units containing an aliphatic hydrocarbon unit having at least 3 carbon atoms.

In the present invention the term "principal chain" means a chain containing the main functional group of the polymerization and in this sense the chain may be branched or has a two-dimensional or three dimensional network structure.

Therefore, in the present invention the term "side chain" means any other chain branched from the principal chain defined hereinabove.

By using alike toner, said polyester, as a binder, provides the toner with an excellent anti-offset property. Additionally, a lower softening point of the toner enables satisfactory low temperature fixation. Further, as the drop in glass transition point is inhibited, the toner, which rarely aggregates and features a high degree of anti-blocking property, can be obtained. Consequently, the toner can, without aggregating, behave stably in the form of unit particles, enabling the satisfactory development of image, and image fixation is satisfactorily accomplished at sufficiently high speed with the heat roller fixing method, without accompanying the offset phenomenon.

The following are the details of the present invention.

As monomer components to be used in polymerization of a polyester used as a binder in the present invention, the following, (a)-(c) or (a)-(d), are available. However, the following specific amounts of other monomer components may be added in accordance with specific requirements if they do not jeopardize the purpose of the present invention.

(a) A dihydric alcohol monomer and a divalent carboxylic acid monomer as components consisting a main body of basic structure (principal chain) of a polyester.

(b) A polyhydric alcohol monomer containing at least 3 hydroxy groups and/or polycarboxylic acid monomer containing at least 3 carboxylic acid groups responsible for non-linearization, that is, branching or networking, of polyester.

(c) An alcohol monomer with at least 2 hydroxy groups containing an aliphatic hydrocarbon unit and/or a carboxylic acid monomer with at least 2 carboxylic acid groups containing an aliphatic hydrocarbon unit to introduce the aliphatic hydrocarbon unit in the basic structure (principal chain) of a polyester. In the present invention the aliphatic hydrocarbon unit means one having at least 3, preferably 3-30 carbon atoms. In view of low temperature fixing property, one having 5-22 carbon atoms is especially desirable. When a polyester containing aliphatic hydrocarbon unit having too many carbon atoms is used, anti-blocking property tends to deteriorate.

(d) An alcohol monomer with at least 2 hydroxy groups and/or a carboxylic acid monomer with at least 2 carboxylic acid groups, wherein these monomers have a saturated or unsaturated aliphatic hydrocarbon group, preferably having 3 to 22 carbon atoms, which is connected to the principal monomer chain, and thus the aliphatic hydrocarbon group forms a side chain in the non-linear polyester of the present invention.

As for the examples of above dihydroxy alcohol monomer, the following are available; diols including ethylene glycol, diethylene glycol, triethylene glycol, 1,2-propylene glycol, 1,3-propylene glycol, 1,4-butanediol, neopentyl glycol, 1,4-butendiol; 1,4-bis (hydroxymothyl) cyclohexane, bisphenol A, hydrogenated bisphenol A, etherified bisphenol. Among these examples etherified bisphenol is most preferred. As the examples of etherified bisphenol, the following are included: polyoxypropylene (2,2)-2,2-bis (4'-hydroxyphenyl) propane, polyoxyethylene (2)-2,2-bis (4'-hydroxyphenyl) propane, polyoxypropylene (6)-2,2-bis (4'-hydroxyphenyl) propane, polyoxypropylene (1,3)-2,2-bis (4'-hydroxyphenyl) propane.

As for the examples of carboxylic acid monomer with 2 carboxylic groups described in above (a), the following are available: terephthalic acid, isophthalic acid, cyclohexanedicarboxylic acid, fumaric acid, maleic acid, citraconic acid, adipic acid, sebacic acid, anhydrides or lower alkyl esters containing these acids. Among these examples, an aromatic series dicarboxylic acid is most desirable and by employing this aromatic series dicarboxylic acid the drop of glass transition point Tg can be inhibited. As to such an aromatic series dicarboxylic acid, the following are available: terephthalic acid, isophthalic acid, cyclohexanedicarboxylic acid, anhydrides or lower alkyl esters containing these acids. The employment of aromatic series dicarboxylic acid should be preferably more than 30 mol % of the whole acid component. If the employment of aromatic series dicarboxylic acid is excessively small, the glass transition point of produced polyester may become excessively low, and the toner tends to aggregate and have poor anti-blocking property. As a result, shelf-life stability or developing property of the toner may deteriorate.

As for polyhydric alcohol monomers containing at least three hydroxy groups, discussed in (b) above, there are, for example: sorbitol, 1,2,3,6-hexanetetrol, 1,4-sorbitan, pentaerythritol, dipentaerythritol, tripentaerythritol, saccharose, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzine. The employment of a polyhydric alcohol containing at least 3 hydroxy groups should be preferably 1-30 mol % of the whole alcohol component. If an excessively large amount of a polyhydric alcohol is employed, the low temperature fixing property of the toner often deteriorates. On the other hand, if excessively small amount of polyhydric alcohol is employed, insufficient linearization of the polyester may jeopardize the anti-offset property of the toner.

As for polyhycarboxylic acid monomers containing at least 3 carboxylic groups discussed in (b) above, there are, for example: 1,2,4-benzenetricarboxylic acid, 1,3,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxylpropane, tetra (methylenecarboxylic) methane, 1,2,7,8-octanetetracarboxylic acid, empoltrimer acid, anhydrides of these acids. The employment of a polycarboxylic acid monomer containing at least 3 carboxylic groups should be preferably 1-30 mol % 5 of the whole alcohol component. If an excessively large amount of a polycarboxylic acid is employed, the low temperature fixing property of the toner often deteriorates. On the other hand, if an excessively small amount of a polycarboxylic acid is employed, insufficient linearization of the polyester may jeopardize the anti-offset property of the toner.

As for a polyhydric alcohol monomer, discussed in (c) above, having a long chained aliphatic hydrocarbon unit and containing at least 2 hydroxy groups, the following are available: propylene glycol, 1,4-butanediol, 1,6-hexanediol. As for a polycarboxylic acid monomer, discussed in (c) above, having a long chained aliphatic hydrocarbon unit and containing at least 2 carboxylic groups, the following are available: glutaric acid, adipic acid, pimelic acid, suberic acid, azelaic acid, sebacic acid. These polyhydric alcohol monomers having at least 2 hydroxy groups or a polycarboxylic acid monomer having at least 2 carboxylic groups which contain a long chained aliphatic hydrocarbon unit should be employed at a ratio with which a principal chain of non-linear polyester involves a long chained aliphatic hydrocarbon unit comprising 1-60 mol %, or more preferably, 5-50 mol %, of the structural unit of said principal chain. Additionally, if the non-linear polyester according to the present invention has in its side chain a saturated or unsaturated aliphatic hydrocarbon unit containing 3-22 carbon atoms, the polyhydric alcohol monomer, above, or a polycarboxylic acid monomer should comprise 1-30 mol %, or more preferably, 5-20 mol % of a structural unit of a principal chain. If the proportion of a long chained aliphatic hydrocarbon unit within a non-linear polyester principal chain is excessively small, a toner may have an unsatisfactory low temperature fixing property. On the other hand, if the above proportion is excessively great, an excessively low glass transition point Tg may result in a toner which easily aggregates. In this case, as a softening point is also excessively low, the anti-offset property of the toner may deteriorate.

As for a polyhydric alcohol monomer, discussed in (d) above, having at least 2 hydroxy groups and containing a saturated or unsaturated aliphatic hydrocarbon unit involving 3-22 carbon atoms, a polyhydric alcohol monomer in which a part of polyhydric alcohol monomer containing at least 2 hydroxy groups (for example, a hydrogen atom) has been substituted by a saturated or unsaturated aliphatic hydrocarbon group having 3-22 carbon atoms can be mentioned. As the examples for such a polyhydric alcohol monomer, ethylene glycol, 1,3-propylenediol, tetramothyl glycol, 1,4-butylenediol, 1,5-pentyldiol, 1,5-petiline glycol, pentamethylene glycol, octamethylene glycol, nonamethylene glycol, decamethylene glycol, diethyele glycol, triethylene glycol, tetraethylene glycol can be mentioned. Additionally, as the polycarboxylic acid monomer, discussed in (d) above, a polyarboxylic acid monomer in which a part of the polycarboxylic acid monomer containing at least 2 carboxylic groups has been substituted by a saturated or unsaturated aliphatic hydrocarbon group preferably having 3-22 carbon atoms can be mentioned. More specifically, n-dodecenylbutaneodic acid, isododecenylbutaneodic acid, n-dodecylbutaneodic acid, isododecylbutaneodic acid, isoctylbutaneodic acid, n-octylbutaneodic acid, n-butyl can be mentioned as preferable examples. The proportion of above polyhydric alcohol monomer and/or polycarboxyl acid monomer to be employed in the polyester of the invention, in terms of total of both components is 0.5-50 mol %, more preferably, 1-35 mol % of the whole monomer components. If the employment of these components is excessively great, the toner containing them becomes prone to aggregation and less resistant to blocking.

The principal chain of the polyester according to the present invention may include other aliphatic hydrocarbon unit such as an unsaturated apliphatic hydrocarbon, for instance, along with the above mentioned components. As for a monomer to introduce such an unsaturated aliphatic hydrocarbon unit, a polyhydric alcohol monomer containing at least 2 hydroxy groups and involving an unsaturated aliphatic acid unit and/or a polycarboxylic acid group containing at least 2 carboxylic acid groups and involving an unsaturated apliphatic acid unit are available. As for examples of the former polyhydric alcohol monomer containing at least 2 hydroxy groups and involving an unsaturated aliphatic hydrocarbon group, there is butendiol. As to the latter polycarboxylic acid monomer containing at least 2 carboxylic acid groups and involving an unsaturated aliphatic hydrocarbon unit, there are such examples as fumaric acid, maleic acid, citraconic acid, mesaconic acid, itaconic acid, and glutaconic acid. Monomers containing an unsaturated aliphatic hydrocarbon unit should be employed in a manner so that the total of like unsaturated aliphatic hydrocarbon unit and a long chained aliphatic hydrocarbon unit, previously described in (c), comprises 1-60 mol %, more preferably 5-50 mol %, of a structural unit of a principal chain contained in a non-linear polyester. If a saturated or unsaturated aliphatic hydrocarbon group containing 3-22 carbon atoms is involved, the like employment should comprise 1-30 mol %, more preferably 5-20 mol %, of a structural unit of a principal chain. If too much unsaturated aliphatic hydrocarbon unit is employed, an excessively low glass transition point (Tg) may make a toner prone to aggregation and less resistant to blocking. At the same time, the softening point of the toner becomes too low, causing the anti-offset property of the toner to deteriorate.

The toner according to the present invention for developing an electrostatic image comprises particles made of a previously mentioned specific polymer as a binder and includes a coloring agent and, if necessary, an adding agent within the binder.

As for an above said coloring agent, the following examples are available: carbon black, nigrosine color (C.I. No. 50415B), aniline blue (C.I. No. 50405), chalcoil (C.I. No. azoec Blue 3), chrome yellow (C.I. No. 14090), ultramarine blue (C.I. No. 77103), Dupont oil red (C.I. No. 26105), quioline yellow (C.I. No. 47005), methyline blue chloride (C.I. No. 52015), phtalocyanine blue (C.I. No.4160), malachite green oxalate (C.I. No. 42000), lamp black (C.I. No. 77266), rose bengal (C.I. No. 45435), and mixture of these colors, and others. Sufficient proportion of such a coloring agent should be employed so as to generate a satisfactorily dense image. Normal employment should be, in terms of weight, 1-20 parts against 100 parts binder.

In regard to other adding agents, there are, for instance, an anti-offset agent, a fluidity improving agent and a charge controlling agent. As an anti-offset agent, a polyolefine class wax, a carnauba wax, an alkylene bisaliphatic amide compound are available. As a fluidity improving agent, silica particles, for example, are available.

In addition, when making a magnetic toner, a binder may contain a magnetic substance along with or instead of a coloring agent. As the examples of such a magnetic substance, the following are usable: metals and alloys which show strong ferromagnetism, involving ferrite, magnatite, iron, magnesium, or, chemical compounds involving like metal elements; alloys, not including ferromagnetic elements, which change to ferromagnetic after proper heat treatment, such as manganese-copper-aluminum type or manganese-copper-stannum type Heusler alloy; and chromium dioxide. Like ferromagnetic particles with average grain size as small as 0.1–1 μm are evenly distributed within a binder. The proportion of ferromagnetic particles to be employed is, in terms of weight, 20–70 parts, more preferably, 40–70 parts to 100 parts toner.

Various types of property improving agents may be incorporated into the toner according to the present invention for developing an electrostatic image so as to improve various features of the toner such as: a feature for preventing the so-called filming phenomenon in which toner materials contaminate the surface of the carrier particles and the surface of the latent image-carrying member to deteriorate functions of these particles or member; a feature to improve pulverizability in the course of the pulverizing process which an ordinary toner preparing process accompanies; a feature to improve triboelectric charging property of the toner. For such a property improving agent, a resin obtainable from an un-bridged polymer and containing no insoluble chloroform is preferred. As for such a resin, the following are available: styrenes including styrene and parachlorostyrene; vinylnaphathalene; vinyl esters including vinyl chloride, vinyl bromide, vinyl fluoride, vinyl acetate, vinyl propionate, vinyl benzoate, vinyl acetate; methylenealiphatic carboxylic esters including methyl acrylate, ethyl acrylate, n-butyl acrylate, isobutyl acrylate, dodecyl acrylate, n-octyl acrylate, 2-chloroethyl acrylate, phenyl acrylate, a-methylene chloroacrylate, methyl methacrylate, ethyl methacrylate, butyl methacrylate; acrylonitrile; methacrylonitrite; acrylamide; vinyl ethers including vinyl methyl ether, vinyl isobutyl ether, vinyl ethyl ether; vinyl ketones including vinyl methyl ketone, vinyl hexylketone; N-vinyl compounds including N-vinyl pyrrole, N-vinyl carbazole, N-vinyl indole, N-vinyl pyrolidone; homopolymers obtained by polymerizing above monomers or copolymers obtained by copolymerizing at least two of the above monomers or mixtures of these homopolymers and copolymers; non-vinyl class resins including resin modified phenolformalin resin, oil modified epoxy resin, polyurethane resin, cellulose resin, non-vinyl thermoplastic resins involving polyether resin; mixture of these resins and above mentioned vinyl class resins.

These resins may comprise 90 weight %, for example, of the binder so far as they do not deteriorate the purpose of the present invention.

With the toner according to the present invention for developing an electrostatic latent image, various developing methods are available for generating the image. More precisely, such methods are, for example:

(i) A contact magnetic brush method whereby a magnetic brush comprising a one component or two component developing agent forms a turf with a height greater than the clearance in the area to be developed. The turf is then held on the developer carrying member to introduce the magnetic brush into the area to be developed, whereupon, the toner particles or toner groups within the magnetic brush deposited on an electrostatic latent image to develop a visible image while the brush is rubbing the latent image.

(ii) A jumping magnetic brush method whereby a magnetic brush comprising a one component or two component developing agent forms a turf with a height greater than the clearance in the area to be developed. The turf is then held on the developer carrying member to introduce the magnetic brush into the area to be developed, whereupon, an oscillating electrical field, for example, is exerted simultaneously on the area to be developed to keep the like toner particles or particle groups contained within the magnetic brush jumping and depositing on the latent image so as to develop a visible image.

(iii) A cascade method, etc.

EXAMPLES

The following section describes the present invention. However, it should be noted that these are not all the possible embodiments.

(Preparation of binders)

(1) Binder A

| | |
|---|---|
| Polyoxypropylene (2,2)-2,2-bis (4'-hydroxyphenyl) propane | 688 g |
| Sebacic acid | 323 g |
| Diisopropyl orthotitanate (esterification catalyst) | 0.8 g |

The materials, above, were poured into a 1 round flask which was provided with a thermometer, a stainless steel agitator, a glass tube nitrogen gas inlet as well as a flow-down condenser. The flask was placed on a mantle heater to heat the above materials to 230° C in a chemically inert atmosphere provided by introducing nitrogen gas via a nitrogen gas inlet, allowing the materials to react with each other while being agitated. When the water generated by the reaction ceased flowing, the acid number was measured. The result was 1.5.

Further, after adding 38 g 1,2,4-benzenetricarboxylic acid anhydride, the reaction was further maintained for approximately 8 hours. When the acid number 17 was reached, the reaction was terminated.

A pale yellow solid resin was obtained by this reaction. The softening point of the resin was measured with a "Flowtester CFT-500" manufactured by the Shimadzu Corporation. The result was 125° C.

(2) Binder B

| | |
|---|---|
| Polyoxypropylene (2,2)-2,2-bis (4'-hydroxyphenyl) propane | 482 g |
| Polyoxyethylene (2)-2,2-bis (4'-hydroxyphenyl) propane | 190 g |
| Terephthalic acid | 133 g |
| Sebacic acid | 182 g |
| Diisopropyl orthotitanate (etherification catalyst) | 0.8 g |

The materials, above, were allowed to react in the same manner as in the binder A preparation, whereupon, after adding 38 g benzenetricarboxylic acid anhydride, the reaction was further maintained for approximately 8 hours. When the acid number 16 was reached, the reaction was terminated.

A pale yellow solid resin was obtained by this reaction. The softening point of the resin was measured with a "Flowtester CFT-500" manufactured by the Shimadzu Corporation. The result was 124° C.

(3) Binder C

| | |
|---|---|
| Polyoxypropylene (2,2)-2,2-bis (4'-hydroxyphenyl) propane | 482 g |
| Polyoxyethylene (2)-2,2-bis (4'-hydroxyphenyl) propane | 190 g |
| Terephthalic acid | 133 g |
| Adipic acid | 77 g |
| Diisopropyl orthotitanate (esterification catalyst) | 0.8 g |

The materials, above, were allowed to react in the same manner as in the binder A preparation, whereupon, after adding 38 g 1,2,4-benzenetricarboxylic acid anhydride, the reaction was further maintained for approximately 8 hours. When the acid number 20 was reached, the reaction was terminated.

A pale yellow solid resin was obtained. The softening point of the resin was measured with a "Flowtester CFT-500" manufactured by the Shimadzu Corporation. The result was 128° C.

(4) Binder D

| | |
|---|---|
| Polyoxypropylene (2,2)-2,2-bis (4'-hydroxyphenyl) propane | 482 g |
| Polyoxyethylene (2)-2,2-bis (4'-hydroxyphenyl) propane | 126 g |
| 1,6-hexanediol | 24 g |
| Fumaric acid | 174 g |
| Diisopropyl orthotitanate (esterification catalyst) | 0.8 g |

The materials, above, were allowed to react in the same manner as in the binder A preparation, whereupon, after adding 77 g 1,2,4-benzenetricarboxylic acid anhydride, the reaction was further maintained for approximately 8 hours. When the acid number 22 was reached, the reaction was terminated.

A pale yellow solid resin was obtained. The softening point of the resin was measured with a "Flowtester CFT-500" manufactured by the Shimadzu Corporation. The result was 125° C.

(5) Binder E

| | |
|---|---|
| Polyoxypropylene (2,2)-2,2-bis (4'-hydroxyphenyl) propane | 619 g |
| Sebacic acid | 404 g |
| Diisopropyl orthotitanate (esterification catalyst) | 0.8 g |

The materials, above, were allowed to react in the same manner as in the binder A preparation, whereupon, after adding 14 g pentaerythritol, the reaction was further maintained for approximately 8 hours. When the acid number 20 was reached, the reaction was terminated.

A pale yellow solid resin was obtained. The softening point of the resin was measured with a "Flowtester CFT-500" manufactured by the Shimadzu Corporation. The result was 130° C.

(6) Binder F (for comparison)

| | |
|---|---|
| Polyoxypropylene (2,2)-2,2-bis (4'-hydroxyphenyl) propane | 482 g |
| Polyoxyethylene (2)-2,2-bis (4'-hydroxyphenyl) propane | 190 g |
| Terephthalic acid | 120 g |
| Diisopropyl orthotitanate (esterification catalyst) | 0.8 g |

-continued

The materials, above, were allowed to react in the same manner as in the binder A preparation, whereupon, after adding 138 g 1,2,4-benzenetricarboxylic acid, the reaction was further maintained for approximately 8 hours when the acid number 34 was reached, the reaction was terminated.

A pale yellow solid resin was obtained. The softening point of the resin was measured with a "Flowtester CFT-500" manufactured by the Shimadzu Corporation. The result was 135° C.

(7) Binder G (for comparison)

| | |
|---|---|
| Polyoxypropylene (2,2)-2,2-bis (4'-hydroxyphenyl) propane | 688 g |
| Terephthalic acid | 149 g |
| Fumaric acid | 104 g |
| Diisopropyl orthotitanate (esterification catalyst) | 0.8 g |

The materials, above, were allowed to react in the same manner as in the binder A preparation.

A pale yellow solid resin was obtained. The softening point of the resin was measured with a "Flowtester CFT-500" manufactured by the Shimadzu Corporation. The result was 107° C.

| | |
|---|---|
| Embodiment 1 | |
| Binder A | 100 parts per weight |
| Carbon black | 10 parts per weight |
| Embodiment 2 | |
| Binder B | 100 parts per weight |
| Carbon black | 10 parts per weight |
| Embodiment 3 | |
| Binder C | 100 parts per weight |
| Carbon black | 10 parts per weight |
| Embodiment 4 | |
| Binder D | 100 parts per weight |
| Carbon black | 10 parts per weight |
| Embodiment 5 | |
| Binder E | 100 parts per weight |
| Carbon black | 10 parts per weight |
| Embodiment 6 | |
| Binder A | 20 parts per weight |
| Binder F | 80 parts per weight |
| Carbon black | 10 parts per weight |
| Comparison example 1 | |
| Binder F (for comparison) | 100 parts per weight |
| Carbon black | 10 parts per weight |
| Comparison example 2 | |
| Binder G (for comparison) | 100 parts per weight |
| Carbon black | 10 parts per weight |

With each embodiment and comparison example, the specified materials were, in accordance with an ordinary toner preparation process involving melting, kneading, cooling pulverizing and classifying, processed to obtain a toner with average grain size 10μm. The toners obtainable from above embodiments 1–6 were correspondingly called "toner 1" – "toner 6". The toners obtainable from the comparison examples 1 and 2 above were respectively called "comparison toner 1" and "comparison toner 2".

A minimum fixing temperature and an offset generating temperature were measured on each toner. Additionally, cohesiveness was examined for each toner.

In determining the minimum fixing temperature, an electrophotographic copier, "U-bix 5000", manufactured by Konishiroku Photo Industry Co., Ltd. was employed. The copier had a teflon (polytetrafluoroethylene manufactured by Dupont) surface heat roll as well as a backup roll in which a silicon rubber layer comprising "KE-1300 RTV" manufactured by the Shin-Etsu Chemical Co., Ltd. was coated with a teflon tube. The linear velocity of the heat roll was set at 200 mm/sec. The initial temperature of the same roll was set at 240° C, whereupon, the operational sequence, in which a toner image transferred on a sheet of 64 g/m$^2$ transfer paper was fixed, was continuously repeated at the ambient temperature of 10° C. and more than 20% relative humidity until the heat roll temperature dropped to 140° C. The minimum fixing temperature was designated when a fixed image showed satisfactory rubbing resistivity with a Kim wiper at the lowest heat roll temperature. Additionally, the fixing unit employed here did not contain a silicon oil feeding mechanism.

For measuring the offset generating temperature, a toner image was transferred in the same manner as for taking the minimum fixing temperature measurement, and then, the image was treated with the fixing unit mentioned above. Next, a sheet of blank transfer paper was fed into the fixing unit under the same ambient condition described above to check if the paper was contaminated with a toner. This operational sequence was continuously repeated while lowering the temperature of the heat roll equipped in the fixing unit mentioned above. The offset generating temperature was designated when a toner contaminated the heat roll.

Additionally, after leaving each sample for 48 hours under the ambient condition temperature of 55° C. and relative humidity 40%, the existence and degree of toner aggregation was evaluated to determine the anti-blocking property of each sample.

TABLE 1

| | Softening point (°C.) | Min. fixing temperature (°C.) | Offset generating temperature (°C.) | Anti-blocking property |
|---|---|---|---|---|
| Toner 1 | 125 | 160 | Not less than 240 | Good |
| Toner 2 | 124 | 150 | Not less than 240 | Good |
| Toner 3 | 128 | 150 | Not less than 240 | Good |
| Toner 4 | 125 | 155 | Not less than 240 | Good |
| Toner 5 | 130 | 165 | Not less than 240 | Good |
| Toner 6 | 132 | 180 | Not less than 240 | Good |
| Comparison Toner 1 | 135 | 200 | Not less than 240 | Good |
| Comparison Toner 2 | 107 | 160 | Not less than 170 | Poor |

In the "anti-blocking property" column of Table 1, "Good" means excellent anti-blocking property and minimized toner aggregation, "Poor" means poor anti-blocking property and greater tendency to toner aggregation.

As can be understood from the results in Table 1, the present invention toners 1–6 a lower fixing temperature, a higher offset developing temperature and an excellent anti-blocking property. Such features enable satisfactory image development, because the toner is aggregation resistant. Additionally, such a toner satisfactorily realizes contamination-free image fixation in sufficiently high speed operation.

The toner 6 contains a comparison binder F as well as a binder A, employed in the present invention. It was confirmed that the toner 6 could fully demonstrate the effect contributed by the binder A.

Contrary to this, with the comparison toner 1 of, which binder polyester contains no long chained aliphatic hydrocarbon unit within its principal chain, the higher minimum fixing temperature made it impossible to realize fixation at a speed sufficient for practical use.

In addition, in the case of the comparison toner 2, as the binder polyester comprises a polyhydric alcohol monomer containing at least 3 hydroxy groups and/or polycarboxylic polycarboxylic acid monomer containing at least 3 carboxylic acid groups, the toner had an insufficient anti-blocking property, a poor image developing property and an excessively low offset generating temperature. For this reason, the offset phenomenon often created contaminated images and, consequently, it was difficult to realize image fixation at satisfactorily high speed.

(Binder preparation)

(1) Binder H

| | |
|---|---|
| Polyoxypropylene (2,2)-2,2-bis (4'-hydroxyphenyl) propane | 490 g |
| Polyoxyethylene (2)-2,2-bis (4'-hydroxyphenyl) propane | 160 g |
| Terephthalic acid | 224 g |
| n-dodecenylbutanedioic acid anhydride | 48 g |
| 1-6-hexanediol | 12 g |
| Fumaric acid | 10 g |
| Diisoproxyl orthotitanate (esterifaction catalyst) | 0.8 g |

The materials, above, were poured into a 1 round flask which was provided with a thermometer, a stainless steel agitator, a glass tube nitrogen gas inlet as well as a flow-down condenser. The flask was placed on a mantle heater to heat the above materials to 230° C. in a chemically inert atmosphere provided by introducing nitrogen gas via a nitrogen gas inlet, allowing the material to react each other while being agitated. When the water generated by the reaction ceased flowing, the acid number was measured. The result was 1.5.

Further, after adding 35 g 1, 2, 4-benzenetricarboxylic acid anhydride, the reaction was further maintained for approximately 8 hours. When the acid number 12 was reached, the reaction was terminated.

A pale yellow solid resin was obtained by this reaction. The softening point of the resin was measured with a "Flowtester CFT-500" manufactured by the Shimadzu Corporation. The result was 130° C.

(2) Binder I

| | |
|---|---|
| Polyoxypropylene (2,2)-2,2-bis (4'-hydroxyphenyl) propane | 490 g |
| Polyoxyethylene (2)-2,2-bis (4'-hydroxyphenyl) propane | 130 g |
| Terephthalic acid | 210 g |
| n-dodecenylbutanedioic acid anhydride | 48 g |
| 1-6-hexanediol | 24 g |
| Fumaric acid | 29 g |
| Diisoproxyl orthotitanate (esterifaction catalyst) | 0.8 g |

The materials, above, were allowed to react in the same manner as in the binder A preparation, whereupon, after adding 35 g 1,2,4-benzenetricarboxylic acid anhydride, the reaction was further maintained for approximately 8 hours. When the acid number 12 was reached, the reaction was terminated.

A pale yellow solid resin was obtained by this reaction. The softening point of the resin was measured with a "Flowtester CFT-500" manufactured by the Shimadzu Corporation. The result was 124° C.

(3) Binder J

| | |
|---|---|
| Polyoxypropylene (2,2)-2,2-bis (4'-hydroxyphenyl) propane | 490 g |
| Polyoxyethylene (2)-2,2-bis (4'-hydroxyphenyl) propane | 160 g |
| Terephthalic acid | 224 g |
| n-dodecenylbutanedioic acid anhydride | 48 g |
| 1-6-hexanediol | 12 g |
| Fumaric acid | 18 g |
| Diisoproxyl orthotitanate (esterifaction catalyst) | 0.8 g |

The materials, above, were allowed to react in the same manner as in the binder A preparation, whereupon, after adding 35 g 1,2,4-benzenetricarboxylic acid anhydride, the reaction was further maintained for approximately 8 hours. When the acid number 10 was reached, the reaction was terminated.

A pale yellow solid resin was obtained by this reaction. The softening point of the resin was measured with a "Flowtester CFT-500" manufactured by the Shimadzu Corporation. The result was 122° C.

(4) Binder K

| | |
|---|---|
| Polyoxypropylene (2,2)-2,2-bis (4'-hydroxyphenyl) propane | 482 g |
| Polyoxyethylene (2)-2,2-bis (4'-hydroxyphenyl) propane | 190 g |
| Terephthalic acid | 210 g |
| n-dodecenylbutanedioic acid anhydride | 48 g |
| Adipic acid | 31 g |
| Diisoproxyl orthotitanate (esterifaction catalyst) | 0.8 g |

The materials, above, were allowed to react in the same manner as in the binder A preparation, whereupon, after adding 35 g 1,2,4-benzenetricarboxylic acid anhydride, the reaction was further maintained for approximately 8 hours. When the acid number 12 was reached, the reaction was terminated.

A pale yellow solid resin was obtained by this reaction. The softening point of the resin was measured with a "Flowtester CFT-500" manufactured by the Shimadzu Corporation. The result was 126° C.

(5) Binder L

| | |
|---|---|
| Polyoxypropylene (2,2)-2,2-bis (4'-hydroxyphenyl) propane | 490 g |
| Polyoxyethylene (2)-2,2-bis (4'-hydroxyphenyl) propane | 160 g |
| Terephthalic acid | 241 g |
| n-dodecenylbutanedioic acid anhydride | 74 g |
| 1,6-hexanediol | 12 g |
| Fumaric acid | 10 g |
| Diisoproxyl orthotitanate (esterifaction catalyst) | 0.8 g |

The materials, above, were allowed to react in the same manner as in the binder A preparation, whereupon, after adding 13 g pentaerythtriol, the reaction was further maintained for approximately 8 hours. When the acid number 13 was reached, the reaction was terminated.

A pale yellow solid resin was obtained by this reaction. The softening point of the resin was measured with a "Flowtester CFT-500" manufactured by the Shimadzu Corp. The result was 130° C.

(6) Binder M (for comparison)

| | |
|---|---|
| Polyoxypropylene (2,2)-2,2-bis (4'-hydroxyphenyl) propane | 490 g |
| Polyoxyethylene (2)-2,2-bis (4'-hydroxyphenyl) propane | 195 g |
| Terephthalic acid | 188 g |
| n-dodecenylbutanedioic acid anhydride | 26.8 g |
| Diisoproxyl orthotitanate (esterifaction catalyst) | 0.8 g |

The materials, above, were allowed to react within the same device as for binder A preparation for approximately 5 hours at 250° C., then: the acid number was measured, of which the result was 2.0

Further, after adding 78.8 g trimellitic acid anhydride, the reaction was further maintained for approximately 4 hours. The reaction was continued for another 2 hours under reduced pressure. When the acid number 12 was reached, the reaction was terminated.

A pale yellow solid resin was obtained by this reaction. The softening point of the resin was measured with a "Flowtester CFT-500" manufactured by the Shimadzu Corporation. The result was 135° C.

(7) Binder N (for comparison)

| | |
|---|---|
| Polyoxypropylene (2,2)-2,2-bis (4'-hydroxyphenyl) propane | 420 g |
| Polyoxyethylene (2)-2,2-bis (4'-hydroxyphenyl) propane | 130 g |
| Terephthalic acid | 179 g |
| n-dodecenylbutanedioic acid anhydride | 48 g |
| 1,6-hexanediol | 48 g |
| Fumaric acid | 42 g |
| Diisoproxyl orthotitanate (esterifaction catalyst) | 0.8 g |

The materials, above, were allowed to react in the same manner as in the binder A preparation, whereupon, after adding 35 g 1,2,4-benzenetricarboxylic acid anhydride, the reaction was further maintained for approximately 8 hours. When the acid number 10 was reached, the reaction was terminated.

A pale yellow solid resin wa obtained by this reaction. The softening point of the resin was measured with a "Flowtester CFT-500" manufactured by the Shimadzu Corporation. The result was 112° C.

| | |
|---|---|
| Embodiment 7 | |
| Binder H | 100 parts per weight |
| Carbon black | 10 parts per weight |
| Embodiment 8 | |
| Binder I | 100 parts per weight |
| Carbon black | 10 parts per weight |
| Embodiment 9 | |
| Binder J | 100 parts per weight |
| Carbon black | 10 parts per weight |
| Embodiment 10 | |
| Binder K | 100 parts per weight |
| Carbon black | 10 parts per weight |
| Embodiment 11 | |
| Binder L | 100 parts per weight |
| Carbon black | 10 parts per weight |
| Embodiment 12 | |
| Binder H | 100 parts per weight |
| Carbon black | 10 parts per weight |

-continued

| | |
|---|---|
| Embodiment 13 | |
| Binder M (for comparison) | 100 parts per weight |
| Carbon black | 10 parts per weight |
| Embodiment 14 | |
| Binder N (for comparison) | 100 parts per weight |
| Carbon black | 10 parts per weight |

For each embodiment and comparison example, specified amounts of ingredients were treated with an ordinary toner preparation method involving melting, kneading, cooling, pulverizing and classifying to obtain a toner with an average grain size of 10μm. The toners obtained from embodiments 7–12 are correspondingly called "toner 7" – "toner 12". The toners prepared in comparison examples 3 and 4 are respectively called "comparison toner 3" and "comparison toner 4".

Each of the toners, above, were examined in the same manner as for embodiments 1–6 for a minimum fixing temperature, an offset generating temperature, and cohesiveness. Table 2 shows the results.

TABLE 2

| | Softening point (°C.) | Min. fixing temperature (°C.) | Offset generating temperature (°C.) | Anti-blocking property |
|---|---|---|---|---|
| Toner 7 | 130 | 150 | Not less than 240 | Good |
| Toner 8 | 124 | 140 | Not less than 240 | Good |
| Toner 9 | 122 | 140 | Not less than 240 | Good |
| Toner 10 | 126 | 150 | Not less than 240 | Good |
| Toner 11 | 130 | 155 | Not less than 240 | Good |
| Toner 12 | 133 | 170 | Not less than 240 | Good |
| Comparison Toner 3 | 135 | 180 | Not less than 240 | Good |
| Comparison Toner 4 | 110 | 160 | 200 | Poor |

In the "anti-blocking property" column of Table 2, "Good" means excellent anti-blocking property and minimized toner aggregation, "Poor means poor anti-blocking property and greater tendency to toner aggregation.

As can be understood from the results in Table 2, the present invention toners 7–12 feature a lower fixing temperature, a higher offset developing temperature, and an excellent anti-blocking property. Such features enable satisfactory image development, because the toner is aggregation resistant. Additionally, such a toner realizes satisfactorily contaminant-free image fixation at a sufficiently high speed.

The toner 12 contains a comparison binder M as well as binder H employed in the present invention. Tests confirmed that the toner 12 could fully demonstrate the effect contributed by the binder H.

Contrary to this, with the comparison toner 4, of which the binder polyester contains no long chained aliphatic hydrocarbon unit within its principal chain, the higher minimum fixing temperature made it impossible to realize a fixation at a speed sufficient for practical use.

In addition, in the case of the comparison toner 3, as the binder polyester comprised a polyhydric alcohol monomer containing at least 3 hydroxy groups and/or polycarboxylic acid monomer containing at least 3 carboxylic acid groups, the toner exhibits an insufficient anti-blocking property, a poor image developing property and an excessively low offset generating temperature. For this reason, the offset phenomenon often caused contaminated image and, consequently, it was difficult to realize image fixation at satisfactorily high speed.

As discussed above, in the present invention toner for developing an electrostatic image, the structure of a binder incorporated in the toner provides the toner with excellent anti-offset property. In addition, a lower softening point of the toner enables satisfactory low temperature fixation. Additionally, because the drop of glass transition point Tg is inhibited, it is possible to obtain a toner which rarely aggregates due to a high degree of blocking resistivity. Consequently, such a toner can, without aggregating, behave stably in unit particles, enabling the satisfactory image development, and the image fixation of the toner is satisfactorily exercised at a sufficiently high speed by incorporating a heat roll fixing method, without any accompanying offset phenomenon.

The precise reasons why the present invention toner for developing an electrostatic image has outstanding properties discussed above are yet to be known. However, one possible reason is that the structure of a polyester employed as a binder provides the toner with a lower softening point, which in turn enables fixation at a satisfactorily low temperature, and, further, the toner itself has both great elasticity in the melted state and an excellent anti-offset property, while featuring the properties whereby a glass transition point Tg does not drop and the toner seldom aggregates.

What is claimed is:

1. A heat fixable toner for developing an electrostatic latent image comprising as a binder a non-linear polyester obtained from polymerization of a monomer composition comprising a polyhydric alcohol monomer containing at least 3 hydroxy groups and/or a polycarboxylic acid monomer containing at least 3 carboxylic acid groups, and wherein said non- linear polyester consists essentially of either first monomer units constituting principal chains thereof and 1 to 60 mol % of the total of said first monomer units contain an aliphatic hydrocarbon unit having at least 3 carbon atoms, or second monomer units constituting principal chains and a side chain thereof and 2 to 65 mol % of the total of said second monomer units contain an aliphatic hydrocarbon unit having at least 3 carbon atoms, and wherein said toner further comprises a coloring agent.

2. The toner of claim 1, wherein said monomer composition comprises a dihydric alcohol monomer and/or a dicarboxylic acid monomer.

3. The toner of claim 1, wherein said aliphatic hydrocarbon unit has 3 to 30 carbon atoms.

4. The toner of claim 2, wherein said aliphatic hydrocarbon unit has 3 to 30 carbon atoms.

5. The toner of claim 4, wherein said aliphatic hydrocarbon unit has 5 to 22 carbon atoms.

6. The toner of claim 1, wherein said non-linear polyester consists essentially of monomer units constituting the principal chains thereof and 5 to 50 mol% of said monomer units contain an aliphatic hydrocarbon unit having at least 3 carbon atoms.

7. The toner of claim 1, wherein said other monomer unit having a side chain contains in the side chain an aliphatic hydrocarbon unit having at least 3 carbon atoms.

8. The toner of claim 7, wherein said non-linear polyester consists essentially of monomer units constituting the principal chains thereof and other monomer units having a side chain, 2 to 65 mol% of the monomer units containing an aliphatic hydrocarbon unit having at least 3 carbon atoms, 1 to 30 mol% of said monomer units constituting the principal chains containing said aliphatic hydrocarbon unit and said other monomer units containing as the side chain a saturated or unsaturated aliphatic hydrocarbon group having 3 to 22 carbon atoms.

9. The toner of claim 7, wherein said non-linear polyester consists essentially of monomer units constituting the principal chains thereof and other monomer units having a side chain 2 to 65 mol% of the monomer units containing an aliphatic hydrocarbon unit having at least 3 carbon atoms, 5 to 20 mol% of said monomer units constituting the principal chains containing said aliphatic hydrocarbon unit and said other monomer units containing as the side chain a saturated or unsaturated aliphatic hydrocarbon group having 3 to 22 carbon atoms.

10. The toner of claim 1, wherein said polyhydric alcohol monomer is selected from the group consisting of sorbitol, 1,2,3,6-hexanetetrol, 1,4-sorbitan, pentaerythritol, dipenta-erythritol, tripentaerythritol, saccharose, 1,2,4-butane-triol, 1,2,5-pentanetrio, glycerol, 2-methylpropanetriol, 2-methyl-1,2,4-butanetriol, trimethylolethane, trimethylol-propane, and 1,3,5-trihydroxymethylbenzine.

11. The toner of claim 1, wherein said polycarboxylic acid monomer is selected from the group consisting of 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalene-tricarboxylic acid, 1,2,4-butanetricarboxylic acid, 1,2,5-hexanetricarboxylic acid, 1,3,-dicarboxy-2-methyl-2-methylenecarbnoxylpropane, tetra(methylenecarboxylic)-methane, 1,2,7,8-octanetetracarboxylic acid, empoltrimer acid and an acid anhydride of these acid monomers.

12. The toner of claim 2, wherein said dihydric alcohol is selected from the group consisting of ethylene glycol, diethylene glycol, triethylene glycol, 1,2-propylene glycol, 1,3-propylenediol, 1,4-butanediol, neopentyl glycol, 1,4-butenediol, 1,4-bis(hydroxymethyl)cyclohexane, bisphenol A, hydrgenated bisphenol A and an eterified bisphenol.

13. The toner of claim 12, wherein said dihydric alcohol is an etherified bisphenol selected from the group consisting of polyoxypropylene(2,2)-2,2-bis(4'-hydroxyphenyl)propane, polyoxyethylene (2)-2,2-bis(4'-hydroxy-phenyl)propane, polyoxypropylene(6)-2,2-bis(4'-hydroxyphenylpropane and polyoxypropylene(1,3)-2,2-bis(4'-hydroxyphenyl)propane

14. The toner of claim 2, wherein said dicarboxylic acid monomer is an aromatic dicarboxylic acid monomer.

15. The toner of claim 2, wherein said dicarboxylic acid monomer is selected from the group consisting of terephthalic acid, isophthalic acid, cyclohexanedicarboxylic acid, fumaric acid, maleic acid, citraconic acid ,adipic acid, sebatic acid, an anhydride thereof and a lower alkyl ester thereof.

16. The toner of claim 1, wherein said monomer units having an aliphatic hydrocarbon unit having more than 3 carbon atoms is selected from the group consisting of ethylene glycol, 1,3-propylene diol tetramethyl glycol, 1,4-butylenediol, 1,5-pentyldiol, 1,5-pentyl gycol, pentamethylene glycol, octamethyleneglycol, nonamethylene glycol, decamethylene glycol, diethylene glycol, triethylene glycol, tetraethylene glycol, propylene glycol, 1,4-butanediol, 1,6-hexanediol, glutaric acid, adipic acid, pimelic acid, suberic acid, azelaic acid and sebacic acid, n-dodecenyl succinic acid, iso-dodecenyl succinic acid, n-dodecyl succinic acid, iso-dodecyl succinic acid, n-octyl succinic acid, iso-octyl succinic acid and n-butyl succinic acid.

17. In a process of transferring an electrostatically produced latent image comprising forming a latent image on a photoconductive photoreceptor by electrostatic charge or light exposure, developing said latent image to produce a toner image, transferring said toner image onto an image transfer sheet, and fixing said toner image on said transfer sheet by heat roller fixing means, the improvement comprising using a toner having a binder comprising a non-linear polyester obtained from polymerization of a monomer composition comprising a polyhydric alcohol monomer containing at least 3 hydroxy groups and/or a polycarboxylic acid monomer containing at least 3 carboxylic acid groups, and wherein said non-linear polyester consists essentially of either first monomer units constituting principal chains thereof and 1 to 60 mol % of the total of said first monomer units contain an aliphatic hydrocarbon unit having at least 3 carbon atoms, or second monomer units constituting principal chains and a side chain thereof and 2 to 65 mol % of the total of said second monomer units contain an aliphatic hydrocarbon unit having at least 3 carbon atoms, and wherein said toner further comprises a coloring agent.

* * * * *